US008181929B2

(12) United States Patent
Fawcett et al.

(10) Patent No.: US 8,181,929 B2
(45) Date of Patent: May 22, 2012

(54) DISPLAY STAND INCLUDING MEANS FOR DISPENSING AND COLLECTING HELICAL CABLE

(75) Inventors: Chris Fawcett, Charlotte, NC (US); Larry K. Hooks, Jr., Fort Mill, SC (US); Mitchell S. Goldstein, Rock Hill, SC (US)

(73) Assignee: InVue Security Products, Inc., Charlotte, NC (US)

( * ) Notice: Subject to any disclaimer, the term of this patent is extended or adjusted under 35 U.S.C. 154(b) by 671 days.

(21) Appl. No.: 12/246,900

(22) Filed: Oct. 7, 2008

(65) Prior Publication Data

US 2009/0173868 A1 Jul. 9, 2009

Related U.S. Application Data

(60) Provisional application No. 61/019,453, filed on Jan. 7, 2008.

(51) Int. Cl.
*F16M 13/00* (2006.01)

(52) U.S. Cl. ..... 248/551; 248/176.1; 248/346.06; 340/568.2

(58) Field of Classification Search ..... 340/568.1, 340/568.2; 242/388, 397, 615, 615.3; 248/551, 248/176.1, 346.06
See application file for complete search history.

(56) References Cited

U.S. PATENT DOCUMENTS

| | | | | |
|---|---|---|---|---|
| 3,195,831 | A * | 7/1965 | Voss et al. | 242/388 |
| 4,384,688 | A | 5/1983 | Smith | |
| 6,380,855 | B1 | 4/2002 | Ott | |
| 6,831,560 | B2 * | 12/2004 | Gresset | 340/568.2 |
| 7,104,492 | B1 * | 9/2006 | Massell et al. | 242/397 |
| 7,714,722 | B2 * | 5/2010 | Marszalek et al. | 340/568.2 |
| 7,724,135 | B2 * | 5/2010 | Rapp et al. | 340/568.1 |
| 2006/0131457 | A1 * | 6/2006 | Nohren et al. | 242/384.7 |
| 2007/0145209 | A1 | 6/2007 | Marsilio et al. | |
| 2009/0289139 | A1 * | 11/2009 | Tsai | 242/397 |
| 2010/0320304 | A1 * | 12/2010 | Iguchi et al. | 242/388.91 |
| 2011/0084838 | A1 * | 4/2011 | Fawcett | 340/568.8 |
| 2011/0199210 | A1 * | 8/2011 | McLean | 340/568.1 |

FOREIGN PATENT DOCUMENTS

| | | | |
|---|---|---|---|
| DE | 19951020 | A1 | 6/2001 |
| WO | 2001097661 | A1 | 12/2001 |
| WO | 2005027694 | A2 | 3/2005 |

* cited by examiner

*Primary Examiner* — Bradley Duckworth
(74) *Attorney, Agent, or Firm* — Christopher C. Dremann, P.C.

(57) ABSTRACT

A display stand for displaying an article of merchandise includes a base defining an outer periphery and means for dispensing and collecting a helical cable attached to the article of merchandise. The means for dispensing and collecting supports and guides the helical cable along the outer periphery of the base between a retracted length and an extracted length. The dispensing and collecting means may include at least one wheel disposed on the outer periphery of the base. The dispensing and collecting means may include at least one roller disposed on the outer periphery of the base. The dispensing and collecting means may include a low-friction surface disposed on the outer periphery of the base. The dispensing and collecting means may include a scalloped surface disposed on the outer periphery of the base. The display stand may further include a collection tube for delivering the helical cable to the article.

18 Claims, 9 Drawing Sheets

DISPLAY STAND INCLUDING MEANS FOR DISPENSING AND COLLECTING HELICAL CABLE

CROSS REFERENCE TO RELATED APPLICATION

This application claims the benefit of U.S. Provisional Application No. 61/019,453, filed Jan. 7, 2008.

BACKGROUND OF THE INVENTION

This invention relates generally to security systems for displaying articles of merchandise, while deterring theft and preventing inadvertent removal of the merchandise from a display area by an unauthorized person. More particularly, the invention relates to a merchandise display stand including means for dispensing and collecting a helical cable attached to an article of merchandise.

It is common practice for retailers to display articles of merchandise, such as relatively small, relatively expensive consumer electronics products, in a display area of a retail store on a display stand of a merchandise security system. The display stand allows a potential purchaser to closely examine and operate an article of merchandise prior to purchasing the item. At the same time, the security system deters theft or removal of the article of merchandise from the display area by an unauthorized person. The use of a merchandise security system including a display stand also improves sales efficiency and reduces labor costs by permitting a potential purchaser to examine and operate a sample of the merchandise at his or her leisure regardless of the availability of a salesperson. The relatively small size and expense of the consumer electronics products, however, increases the possibility that the merchandise will be stolen or maliciously removed from the display area by an unauthorized person.

A known disadvantage of conventional merchandise security systems is that the cable for mechanically securing the article of merchandise to a fixed support and the cable for powering the alarm are visible, distracting and oftentimes unsightly. Furthermore, the security cable and the electrical cable can become twisted or entangled and render it difficult, or even impossible, for the potential purchaser to examine and operate the article of merchandise. One known solution to this problem is to provide a device, commonly referred to as a "recoiler," for permitting one or more cables to be extracted (i.e. dispensed) under an applied stress or tension, while biasing the cables to return to the retracted (i.e. collected) condition. Such recoiler devices, however, oftentimes exert a biasing force so excessive that it is cumbersome for a potential purchaser to readily examine and operate the article of merchandise attached to the cable(s).

Another known solution addressing this same problem is to combine the security cable and electrical cable into a unitary helical cable, similar to a tightly-coiled telephone cord, having sufficient elasticity to be reversibly extensible in response to an applied stress or tension. In other words, the helical cable can be easily stretched to an extended length and tends to return to its unstressed length when released. The helical cable typically runs between a fixed connection to a power supply and a sensor affixed to the article of merchandise, and is therefore commonly referred to as a "sensor cable." The helical cable, however, may still become twisted or entangled, and thus, fail to return to a fully collected condition. As a result, the display area may appear disorganized or cluttered, and thereby possibly dissuade the potential purchaser from purchasing the merchandise.

Accordingly, there exists a need for an improved security system for displaying articles of merchandise, while deterring theft and preventing inadvertent removal of the merchandise from a display area by an unauthorized person. More particularly, there exists a need for a security system having a display stand including means for dispensing and collecting a helical cable that is attached to an article of merchandise. There exists a specific, unresolved need for a display stand including means for dispensing and collecting a helical cable without the helical cable becoming twisted or entangled.

BRIEF SUMMARY OF THE INVENTION

The aforementioned needs, objectives and advantages, as well as others that will be readily apparent to those skilled in the art, are provided by an improved security system for displaying articles of merchandise, while deterring theft and preventing inadvertent removal of the merchandise from a display area by an unauthorized person. In one aspect, the present invention provides a display stand for displaying an article of merchandise including a base defining an outer periphery and means for dispensing and collecting a helical cable attached to the article of merchandise. The means for dispensing and collecting guides the helical cable along the outer periphery of the base between a retracted length and an extracted length. The display stand may further include a collection tube mounted on and depending from the base and having an interior passageway formed therethrough for delivering the helical cable to the article of merchandise.

In one embodiment, the means for dispensing and collecting includes at least one wheel disposed on the outer periphery of the base.

In another embodiment, the means for dispensing and collecting includes at least one roller disposed on the outer periphery of the base.

In yet another embodiment, the means for dispensing and collecting includes a low-friction surface disposed on the outer periphery of the base.

In still another embodiment, the means for dispensing and collecting includes a scalloped surface disposed on the outer periphery of the base.

BRIEF DESCRIPTION OF THE DRAWINGS

The present invention is best understood by reference to the following detailed description when taken in conjunction with the accompanying drawing figures.

DETAILED DESCRIPTION OF THE INVENTION

Figure 1A:
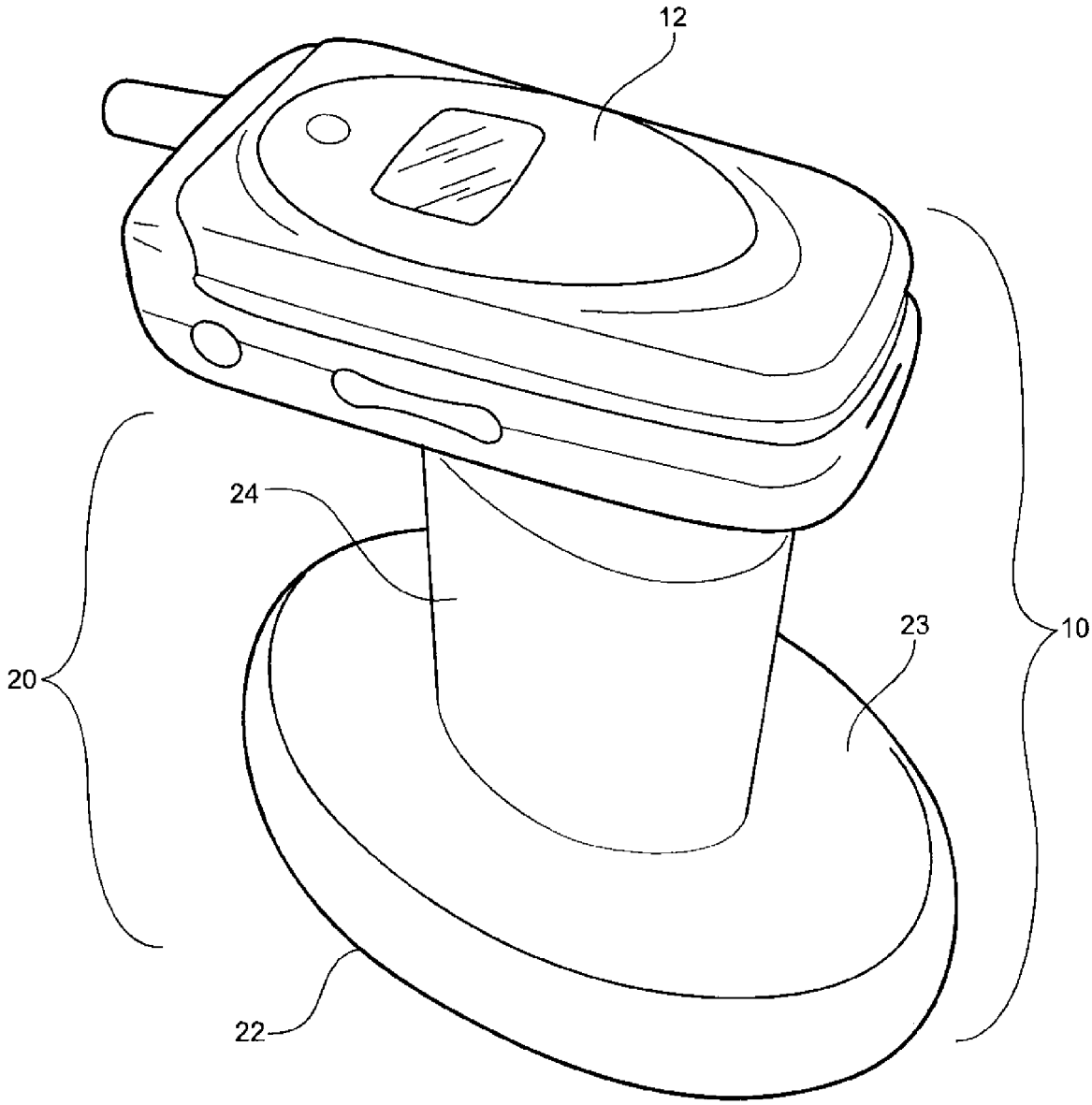
FIG. 1A is a top perspective view of a display stand of a merchandise security system including means for dispensing and collecting a helical cable according to the present invention shown with the helical cable retracted.

Referring now to the accompanying drawing figures wherein identical reference numerals denote the same elements throughout the various views, a merchandise security system, indicated generally at 10, according to the present invention is shown. The security system 10 is operable for supporting and displaying articles of merchandise, such as relatively small, relatively expensive consumer electronics products (e.g. mobile telephones, digital cameras, digital music players, etc.), indicated generally at 12, on a display stand 20. The security system 10 is commonly utilized in a retail store to permit a potential purchaser to closely examine and operate an article of merchandise 12, while deterring theft and preventing inadvertent removal of the merchandise from a display area by an unauthorized person.

As shown and described herein, the security system 10 comprises a sensor 14 affixed to the article of merchandise 12 for detecting when the article is separated from the sensor. The security system 10 typically further comprises a power supply (not shown) for supplying electrical power to the sensor 14, and optionally the article of merchandise 12, and an alarm (not shown) that produces an audible or visible alert when the article is separated from the sensor or when electrical power to the sensor is interrupted. The sensor 14 is electrically coupled to the power supply by a helical cable 15 that extends between the power supply and the sensor. Accordingly, the helical cable 15 is commonly referred to as a "sensor cable." The helical cable 15 is attached to the sensor 14 in a manner that prevents it from being readily detached from the sensor. As such, the helical cable 15 further acts as a security cable for mechanically securing (i.e. physically attaching) the article of merchandise 12 to a fixed support. A display stand 20 according to the present invention, however, may also be utilized independent of the sensor 14, the power supply and the alarm to merely display the article 12 on a display stand having an extensible and retractable helical cable 15. In the latter instance, the article of merchandise 12 may be powered by an internal power source, such as a battery, and the helical cable 15 serves to only physically attach the article of merchandise to the display stand 20. If desired, the cable 15 may be strengthened sufficiently to likewise mechanically secure the article 12 to a fixed support beyond the display stand 20.

Regardless, the helical cable 15 is constructed similar in form to a conventional tightly-coiled telephone cord. As a result, the helical cable 15 has sufficient elasticity to be reversibly extensible in response to an applied stress or tension. In other words, the helical cable 15 can be easily stretched to an extended (also referred to herein as "extracted") length and tends to return to its pre-stretched (also referred to herein as "retracted") length when released. A helical cable 15 suitable for use with the present invention is elastically extensible to an extended length of at least about one and one-half times its unstressed length, and returns to within at least about five percent of its unstressed length after being extended. Thus, the helical cable 15 has an elongation of at least about 150% and a memory of at least about 95%. Such cords and cables are readily available and well known to those skilled in the art, and therefore, need not be further described with regard to the present invention.

Figure 1B:
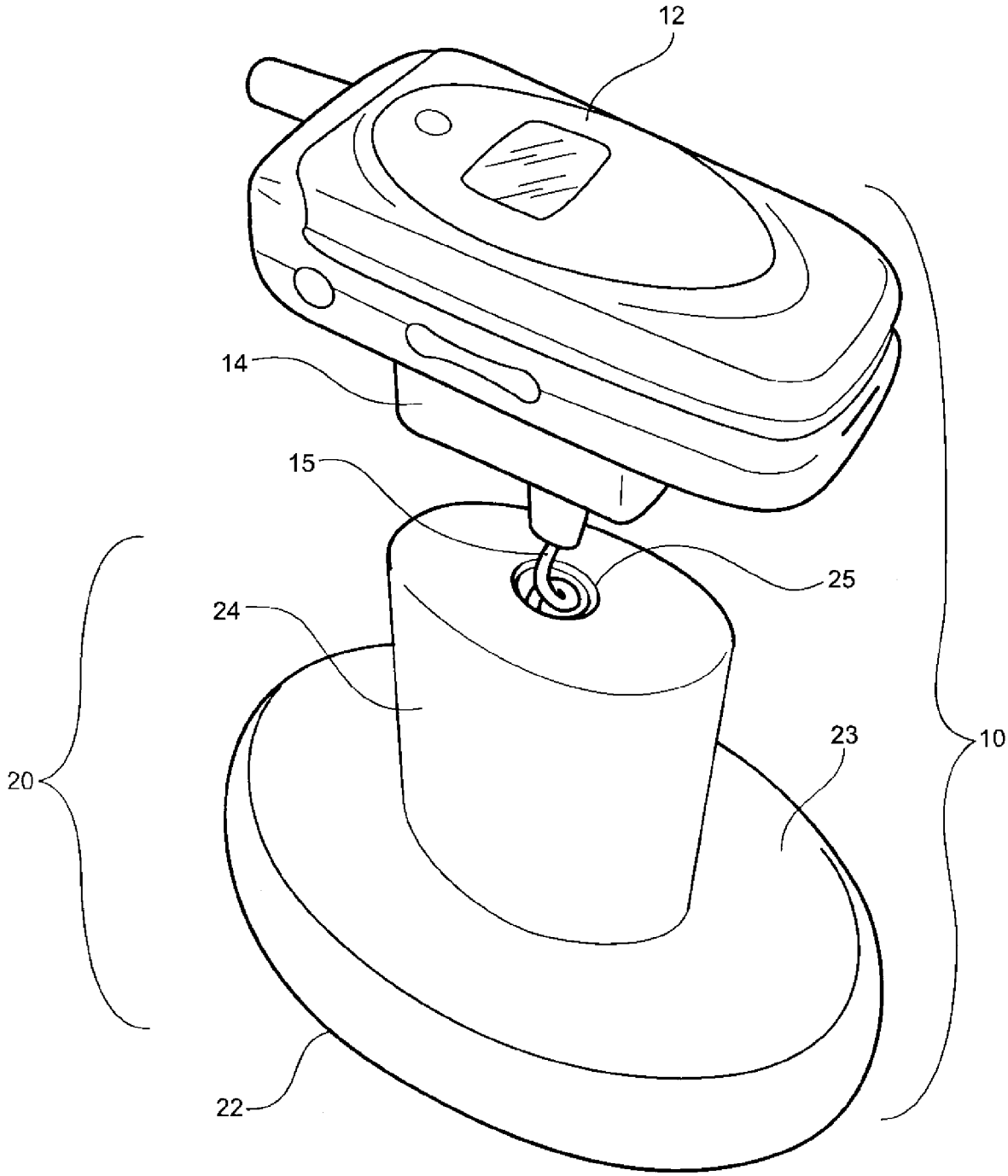
FIG. 1B is a top perspective view of the display stand of FIG. 1A shown with the helical cable partially extended.

FIG. 1A and FIG. 1B show a display stand 20 of a security system 10 including means 30 for dispensing and collecting a helical cable 15 according to the present invention. The helical cable 15 is shown collected (i.e. retracted) within the display stand 20 in FIG. 1A, and is shown dispensed (i.e. extracted) partially from the display stand in FIG. 1B. As used herein, the term "dispensing" refers to the action of extending or extracting the helical cable 15 from the display stand 20, for example when a potential purchaser lifts the article of merchandise 12 off the display stand to examine and/or operate the article. Similarly, the term "collecting" refers to the action of releasing or retracting the helical cable 15 to the display stand 20, for example when the potential purchaser returns the article of merchandise 12 to the display stand. As previously mentioned, the helical cable has a natural tendency to return to its unstressed length after being dispensed to a stressed length by virtue of the helical, tightly-coiled construction of the cable.

The display stand 20 shown in FIG. 1A and FIG. 1B comprises a base 22 and a collection tube 24 mounted thereon and depending upwardly from the base. The display stand 20 further comprises a cover 23 that extends between the base 22 and the collection tube 24 and overlies the base. The base 22, cover 23 and collection tube 24 may be formed in any known manner from any suitable structural material, such as plastic, composite or metal, but preferably are molded from a hard, durable, lightweight plastic. As shown, the collection tube 24 is generally circular or elliptical and formed as a cylinder having an internal passageway 25 formed therethrough for transitioning the helical cable 15 between the base 22 and the sensor 14 affixed to the article of merchandise 12. The base 22 is generally circular or elliptical and has a diameter substantially greater than the diameter of the collection tube 24, for a purpose to be described. In a collected condition, a majority of the retracted length of the helical cable 15 is stored within the base 22 between the outer periphery of the base and the cover 23. In a dispensed condition, a portion of the length of the helical cable 15 passes through the passageway 25 of the collection tube 24 such that a sufficient length of the helical cable is disposed outside the collection tube to permit the article of merchandise 12 to be examined an/or operated off the display stand 20. When the article or merchandise 12 is replaced on the display stand 20, the dispensed portion of the length of the helical cable 15 returns through the passageway 25 and the retracted length of the helical cable is collected on the base 22.

Figure 2A:
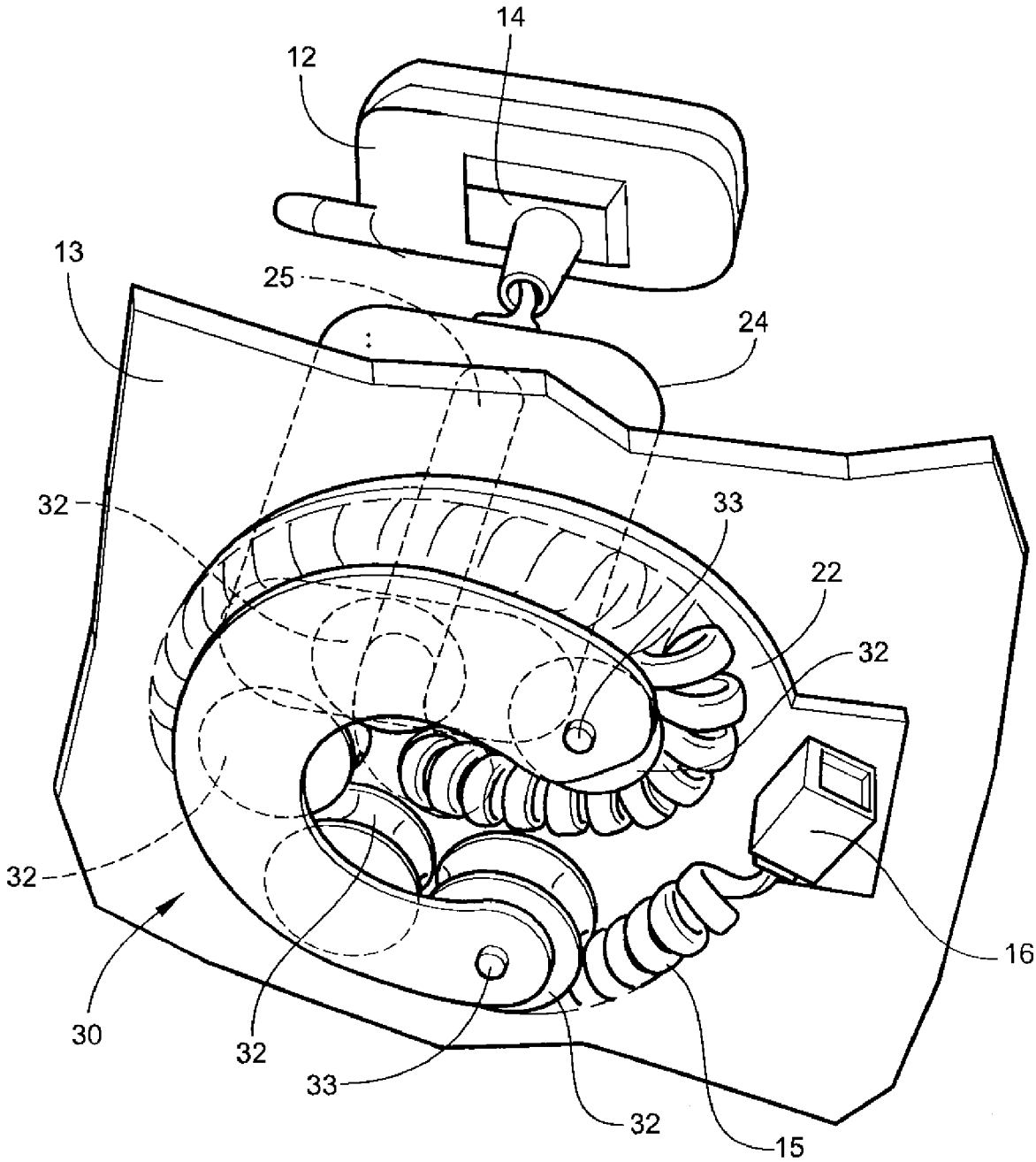
FIG. 2A is a bottom perspective view of one embodiment of a means for dispensing and collecting a helical cable according to the present invention shown with the helical cable retracted.
Figure 2B:
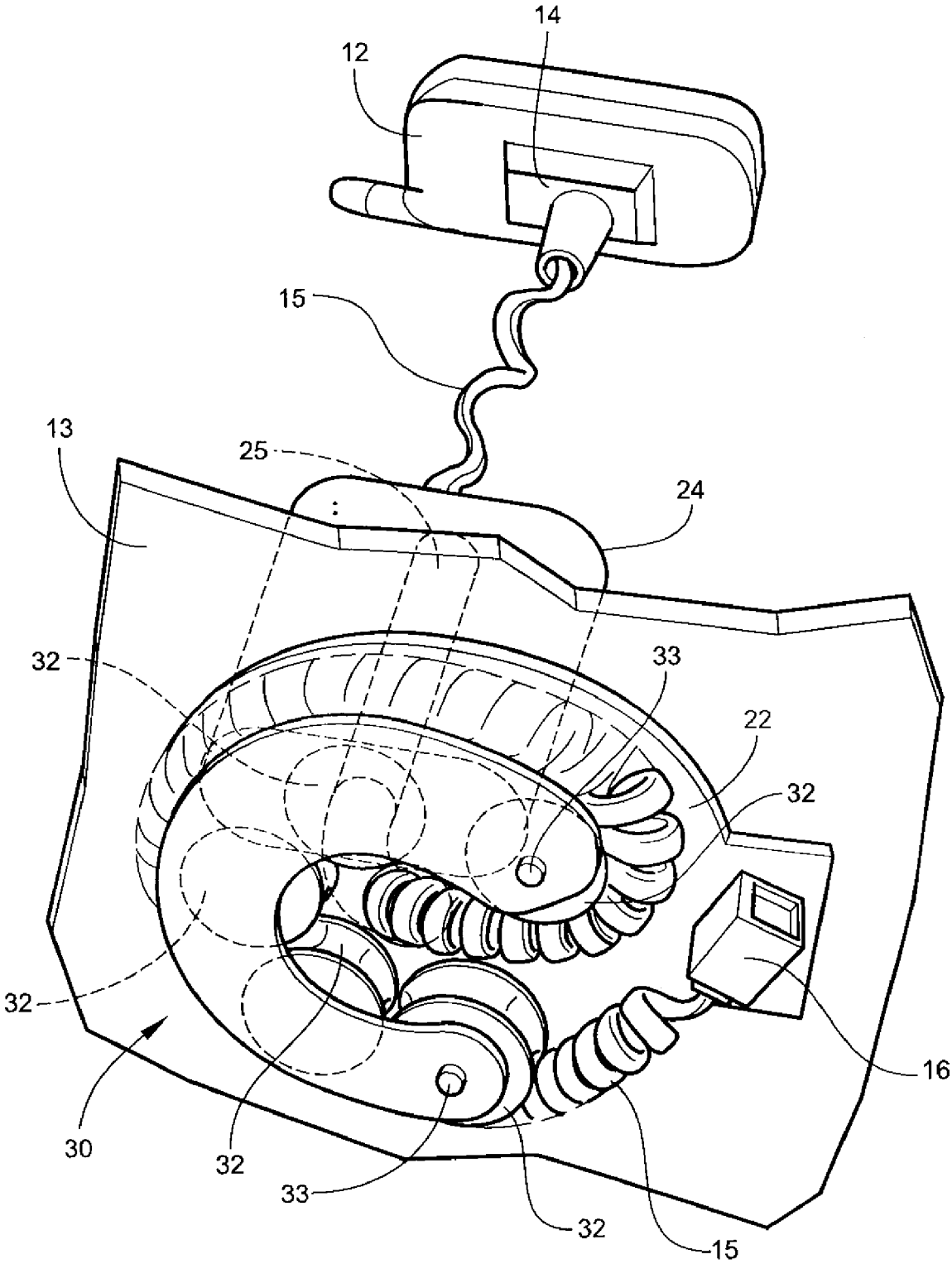
FIG. 2B is a bottom perspective view of the means for dispensing and collecting the helical cable of FIG. 2A shown with the helical cable partially extracted.

FIG. 2A and FIG. 2B show one embodiment of a means 30 for dispensing and collecting a helical cable 15 according to the present invention. The helical cable 15 is shown collected (i.e. retracted) within the display stand 20 in FIG. 2A, and is shown partially dispensed (i.e. extracted) from the display stand in FIG. 2B. In addition, the base 22 of the display stand 20 is shown disposed beneath a display surface 13, such as a counter, table, shelf or desk, while the collection tube 24 extends upwardly from the display surface. Thus, the display surface 13: is disposed between the base 22 and the collection tube 24 and, if desired, the cover 23 may be eliminated from the display stand 20. In this manner, the display stand 20 can be positioned and secured on the display surface 13 in a desirable location with the means 30 for dispensing and collecting the helical cable 15 out of the way and inaccessible to the potential purchaser for purposes of both aesthetics and security. However, one skilled in the art will readily appreciate that all of the display stand 20, or any portion thereof, may be disposed above or below the display surface 13 without departing from the intended scope of the present invention.

Regardless, the means 30 for dispensing and collecting the helical cable 15 depicted in FIG. 2A and FIG. 2B comprises a plurality of generally cylindrical wheels 32 disposed about the outer periphery of the base 22. The wheels 32 support and guide the helical cable 15 within the base 22 to the passageway 25 of the collection tube 24. At least one of the wheels 32 is rotatably mounted on an axle 33 fixed to the base 22. The remainder of the wheels 32 may be fixed so as to merely support and guide the helical cable 15 between the retracted length and the extracted length. As shown herein, both the wheel nearest to and the wheel farthest from the entrance to the passageway 25 of the collection tube along the path of travel of the helical cable 15 are rotatable. Alternatively, more or all of the wheels 32 may be rotatably mounted so as to further facilitate movement of the helical cable 15 between the retracted length and the extracted length. Whether rotatable or fixed, the wheels 32 are made of a smooth material, such as metal or hard plastic, so as to minimize the amount of surface friction between the outer surface of the wheel and the helical cable 15. As will be readily apparent to those skilled in the art, the outer surface of the wheels 32 may be provided with a surface coating or lubrication to further reduce surface friction with the helical cable 15. Furthermore, the contour of the wheels 32 reduces the amount of friction with the helical cable 15.

In the particular embodiment shown in FIG. 2A and FIG. 2B, the means 30 comprises a series of 5 wheels 32 disposed about the outer periphery of the base 22 in a generally U-shaped arrangement. The helical cable 15 extends from a fixed connection 16, such as a connector plug or jack electrically coupled to the power supply, along the wheels 32 around the outer periphery of the base 22. The helical cable 15 extends in a clockwise direction (as viewed from below) along the wheels 32 to the opening of the U-shape, towards the center of the base 22, and then upwardly into the passageway 25 of the collection tube 24. The helical cable 15 is dispensed when the article of merchandise 12 is lifted off the display stand 20 and is collected again when the article is replaced onto the display stand, as previously described. It should be noted that due to the coiled geometry of the helical cable 15, a greater length of the helical cable passes over the wheel 32 located nearest the entrance to the passageway 25 of the collection tube 24 than over the wheel 32 located nearest the fixed connection 16 since a greater amount of the elongation from the retracted length to the extracted length occurs adjacent the end of the helical cable 15 attached to the sensor 14. Accordingly, a progressively lesser length of the helical cable 15 passes over the wheels 32 located medially between the passageway 25 of the collection tube 24 and the fixed connection 16.

Figure 3:
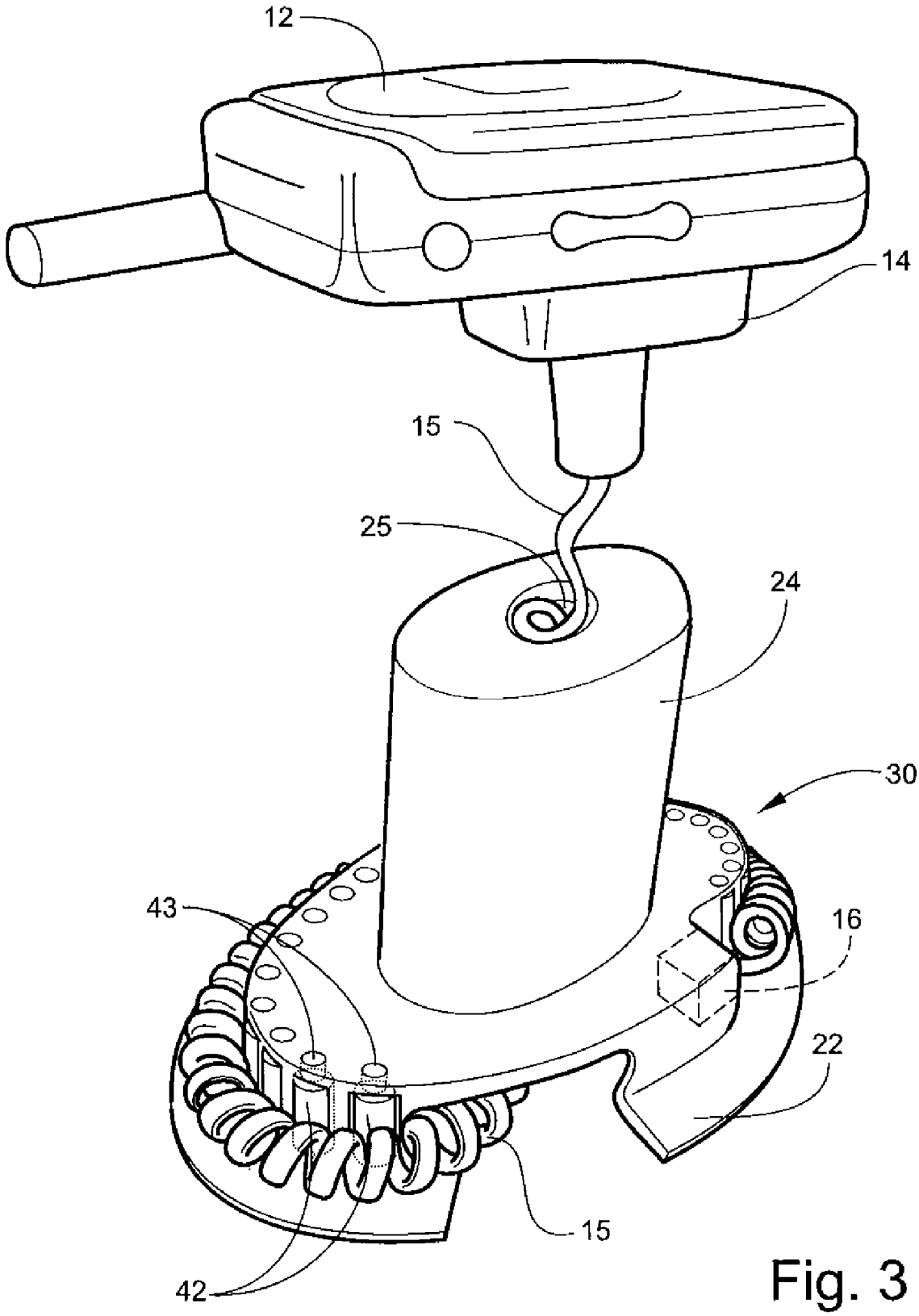
FIG. 3 is a top perspective view of another embodiment of a means for dispensing and collecting a helical cable according to the present invention shown with the cover of the display stand removed for purposes of clarity and with the helical cable retracted.

FIG. 3 shows another embodiment of the means 30 for dispensing and collecting the helical cable 15 according to the present invention. The helical cable 15 is shown collected (i.e. retracted) within the display stand 20 in FIG. 3, the dispensed (i.e. extracted) configuration being substantially identical to the embodiments previously described. As shown, the base 22 of the display stand 20 is configured to be mounted onto the top of a display surface, such as a counter, table, shelf or desk. In addition, the aesthetic and protective cover 23 of the display stand 20 is removed for purposes of clarity. In this embodiment, the means 30 comprises a plurality of generally cylindrical rollers 42 disposed about the outer periphery of the base 22. The rollers 42 support and guide the helical cable 15 within the base 22 to the passageway 25 of the collection tube 24. In particular, the helical cable 15 is guided within the base 22 of the display stand 20 between the outer surface of the rollers 42 and the inner surface of the cover 23 (not shown).

The rollers 42 may be fixedly mounted on the base 22 so as to merely support and guide the helical cable 15 between the retracted length and the extracted length. As shown herein, each of the rollers 42 is rotatably mounted on an axle 43 fixed to the base 22 so as to further facilitate movement of the helical cable 15 between the retracted length and the extracted length. Alternatively, one or more of the rollers 42 may be rotatable, while the remainder of the rollers remain fixed. Whether rotatable or fixed, the rollers 42 are made of a smooth material, such as metal or hard plastic, so as to minimize the amount of surface friction between the outer surface of the roller and the helical cable 15. As will be readily apparent to those skilled in the art, the outer surface of the rollers 42 may be provided with a surface coating or lubrication to further reduce surface friction with the helical cable 15. Furthermore, the contour of the rollers 42 reduces the amount of friction with the helical cable 15.

In the particular embodiment shown in FIG. 3, the rollers 42 are disposed about the outer periphery of the base 22 in a generally U-shaped arrangement. The helical cable 15 extends from a fixed connection 16, such as a connector plug or jack electrically coupled to the power supply, along the rollers 42 around the outer periphery of the base 22. The helical cable 15 extends in a counter-clockwise direction (as viewed from above) along the rollers 42 to the opening of the U-shape, towards the center of the base 22, and then upwardly into the collection tube 24. The helical cable 15 is dispensed when the article of merchandise 12 is lifted off the display stand 20 and is collected again when the article is replaced onto the display stand, as previously described. It should be noted that due to the helical coiled geometry of the helical cable 15, a greater length of the helical cable passes over the rollers 42 located nearer the entrance to the passageway 25 of the collection tube 24 than over the rollers 42 located nearer the fixed connection 16 since a greater amount of the elongation from the retracted length to the extracted length occurs adjacent the end of the helical cable 15 attached to the sensor 14. Accordingly, a progressively lesser length of the helical cable 15 passes over the rollers 42 located medially between the passageway 25 of the collection tube 24 and the fixed connection 16.

Figure 4A:
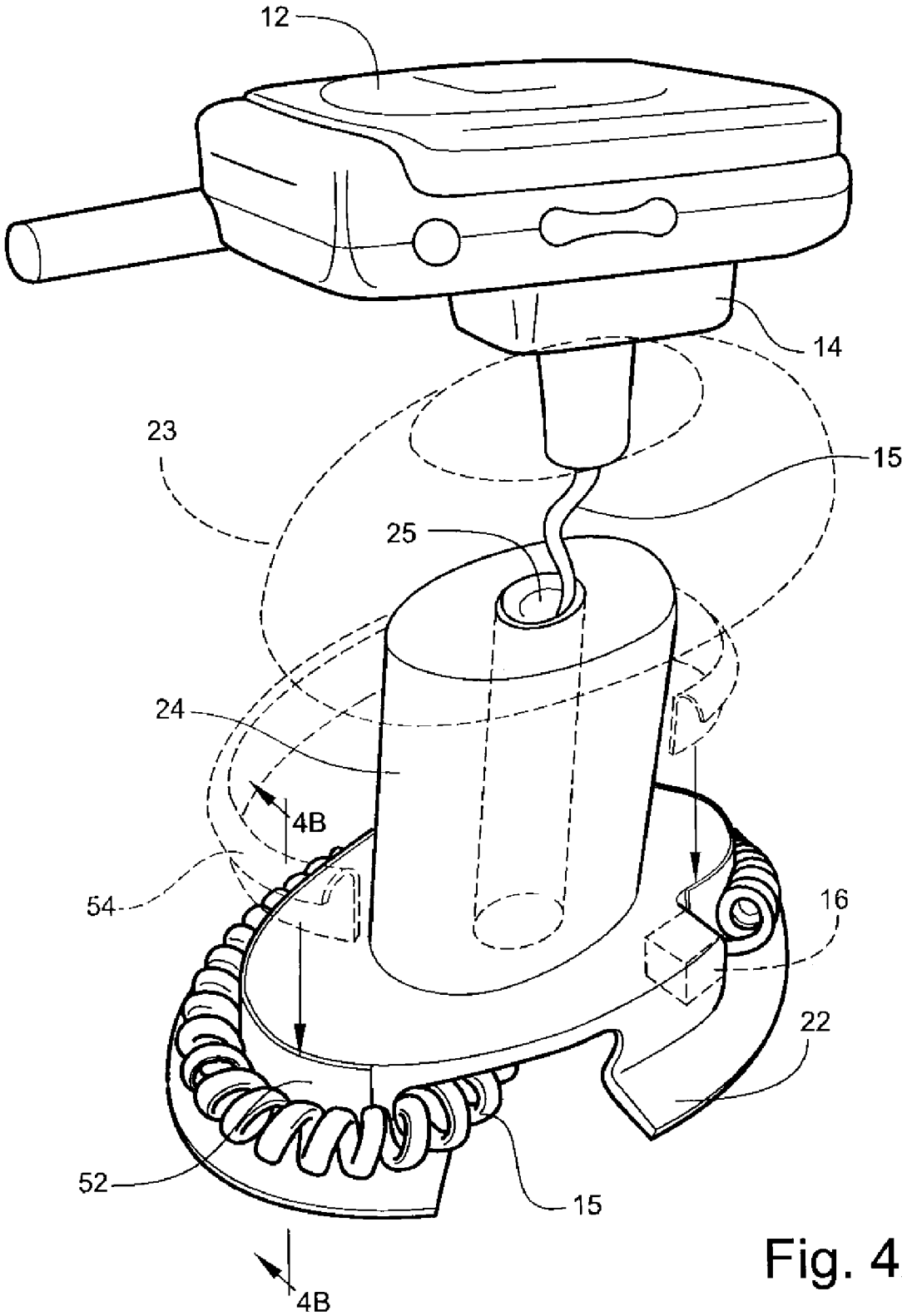
FIG. 4A is a top perspective view of yet another embodiment of a means for dispensing and collecting a helical cable according to the present invention shown with the cover of the display stand exploded for purposes of clarity and with the helical cable retracted.
Figure 4B:
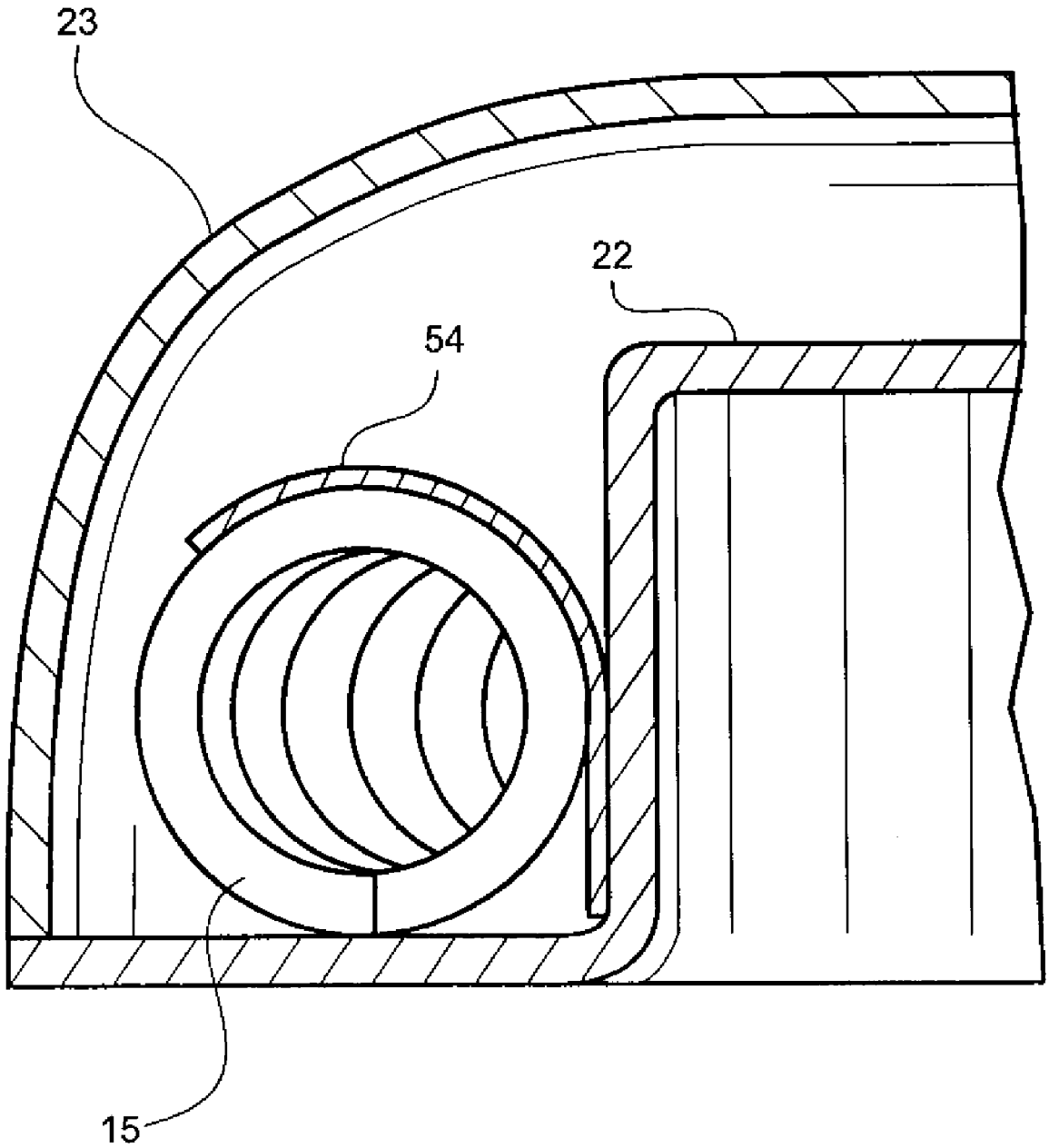
FIG. 4B is a detailed section view of the display stand of FIG. 4A taken along the line 4B-4B.

FIG. 4A and FIG. 4B show another embodiment of the means 30 for dispensing and collecting the helical cable 15 according to the present invention. The helical cable 15 is shown collected (i.e. retracted) within the display stand 20 in FIG. 4A, the dispensed (i.e. extracted) configuration being substantially identical to the embodiments previously described. As shown, the base 22 of the display stand 20 is configured to be mounted onto the top of a display surface, such as a counter, table, shelf or desk. In addition, the aesthetic and protective cover 23 of the display stand 20 is shown exploded upwardly from the base 22 and in broken lines for purposes of clarity.

In this embodiment, the means 30 comprises a smooth, low-friction surface 52 disposed about the outer periphery of the base 22. The surface 52 supports and guides the helical cable 15 on the base 22 to the passageway 25 of the collection tube 24. In particular, the helical cable 15 is guided along the surface 52 on the outer periphery of the base 22 between the base and the inner surface of the cover 23. Preferably, the surface 52 is formed from a metal or hard plastic so as to minimize the amount of friction between the surface 52 and the helical cable 15. As will be readily apparent to those skilled in the art, the surface 52 may be provided with a coating, for example a sprayed layer of Teflon®, or lubrication to further reduce friction with the helical cable 15.

In the particular embodiment shown in FIG. 4A, the surface 52 is disposed about the outer periphery of the base 22 in a generally reverse J-shaped configuration. The helical cable 15 extends from a fixed connection 16, such as a connector plug or jack electrically coupled to the power supply, along the surface 52 around the outer periphery of the base 22. The helical cable 15 extends in a counter-clockwise direction (as viewed from above) along the surface 52 to the opening of the U-shape, towards the center of the base 22, and then upwardly into the collection tube 24. The helical cable 15 is dispensed when the article of merchandise 12 is lifted off the display stand 20 and is collected again when the article is replaced onto the display stand, as previously described. It should be noted that due to the coiled geometry of the helical cable 15, a greater length of the helical cable passes over the portion of the surface 52 nearer the entrance to the passageway 25 of the collection tube 24 than over the portion of the surface 52 nearer the fixed connection 16 since a greater amount of the elongation from the retracted length to the extracted length occurs adjacent the end of the helical cable 15 attached to the sensor 14. Accordingly, a progressively lesser length of the helical cable 15 passes over the portion of the surface 52 located medially between the passageway 25 of the collection tube 24 and the fixed connection 16.

In an alternative embodiment, a relatively thin strip of a low-friction material 54 may be affixed, for example by an adhesive, to the surface 52 about at least a portion of the outer periphery of the base 22. The low-friction material may be any substance that minimizes the amount of resistance generated by the helical cable 15 moving along the surface 52. For purposes of example and without limitation, the low-friction material 54 may include silicone, polytetrafluoroethylene, perfluoroalkoxy, fluorinated ethylene propylene, Teflon®, or an equivalent. In FIG. 4A, the low-friction material 54 is shown exploded upwardly from the base 22 for purposes of clarity. As best shown in FIG. 4B, the low-friction material 54 has a generally inverted J-shaped configuration consisting of an arcuate portion that depends outwardly from the outer periphery of the base 22 (i.e. from surface 52) and a linear portion that is parallel, and preferably, in contact with the outer periphery of the base 22 (i.e. surface 52). As a result, the helical cable 15 is disposed in relatively close relationship between a portion of the surface 52 (i.e. the horizontal portion of the outer periphery of base 22) and the inner surface of the low-friction material 54. In any event, the helical cable 15 is intended to be guided along the outer periphery of the base 22 and is not guided, supported, retained or mechanically restrained in any way by the inner surface of the cover 23. As such, the cover 23 may be eliminated without compromising the function and/or operation of the display stand 20, and in particular the means 30 for dispensing and collecting the helical cable 15, except for the aesthetic and security benefits provided by the cover.

Figure 5A:
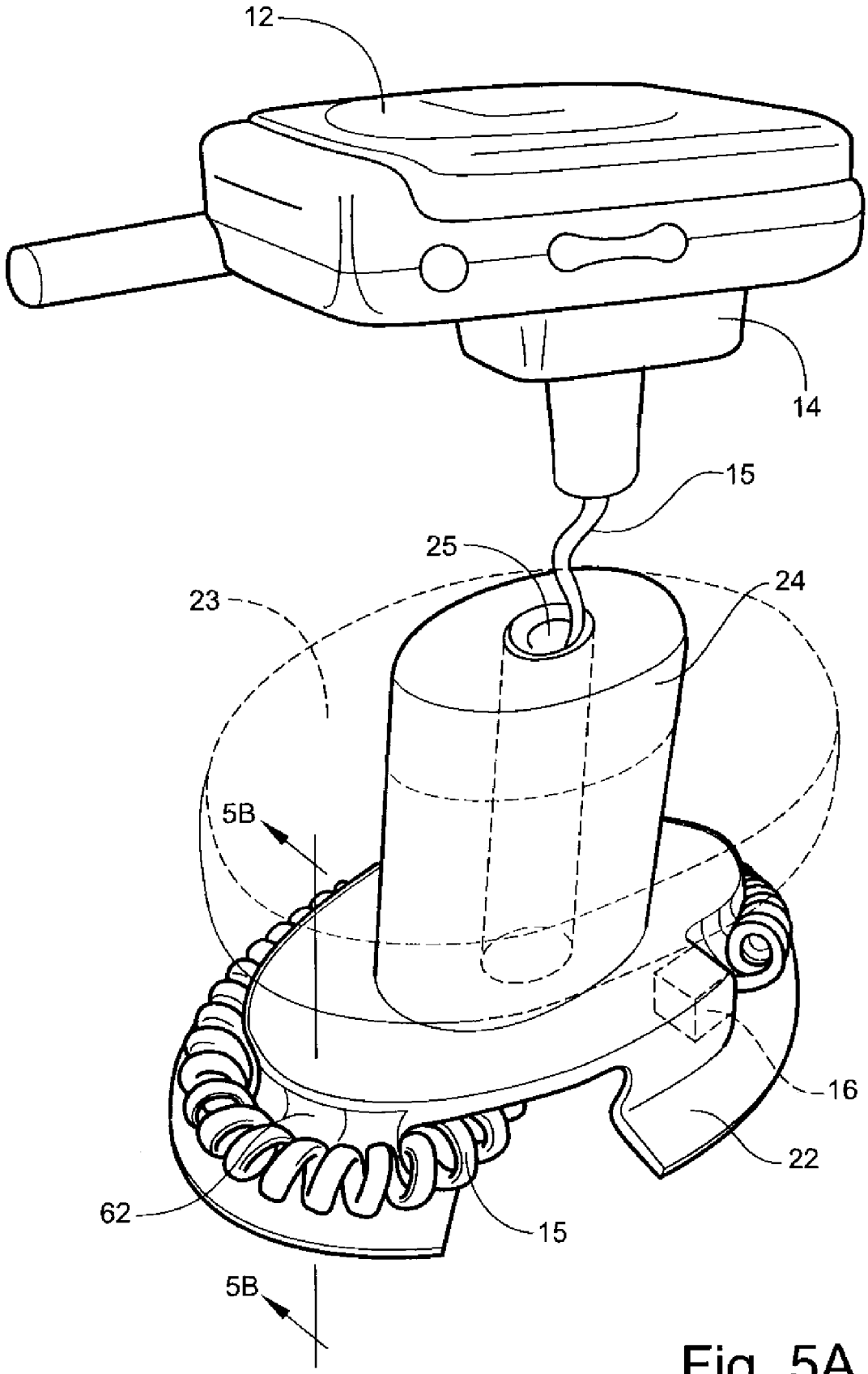
FIG. 5A is a top perspective view of still another embodiment of a means for dispensing and collecting a helical cable according to the present invention shown with the cover of the display stand exploded for purposes of clarity and with the helical cable retracted.
Figure 5B:
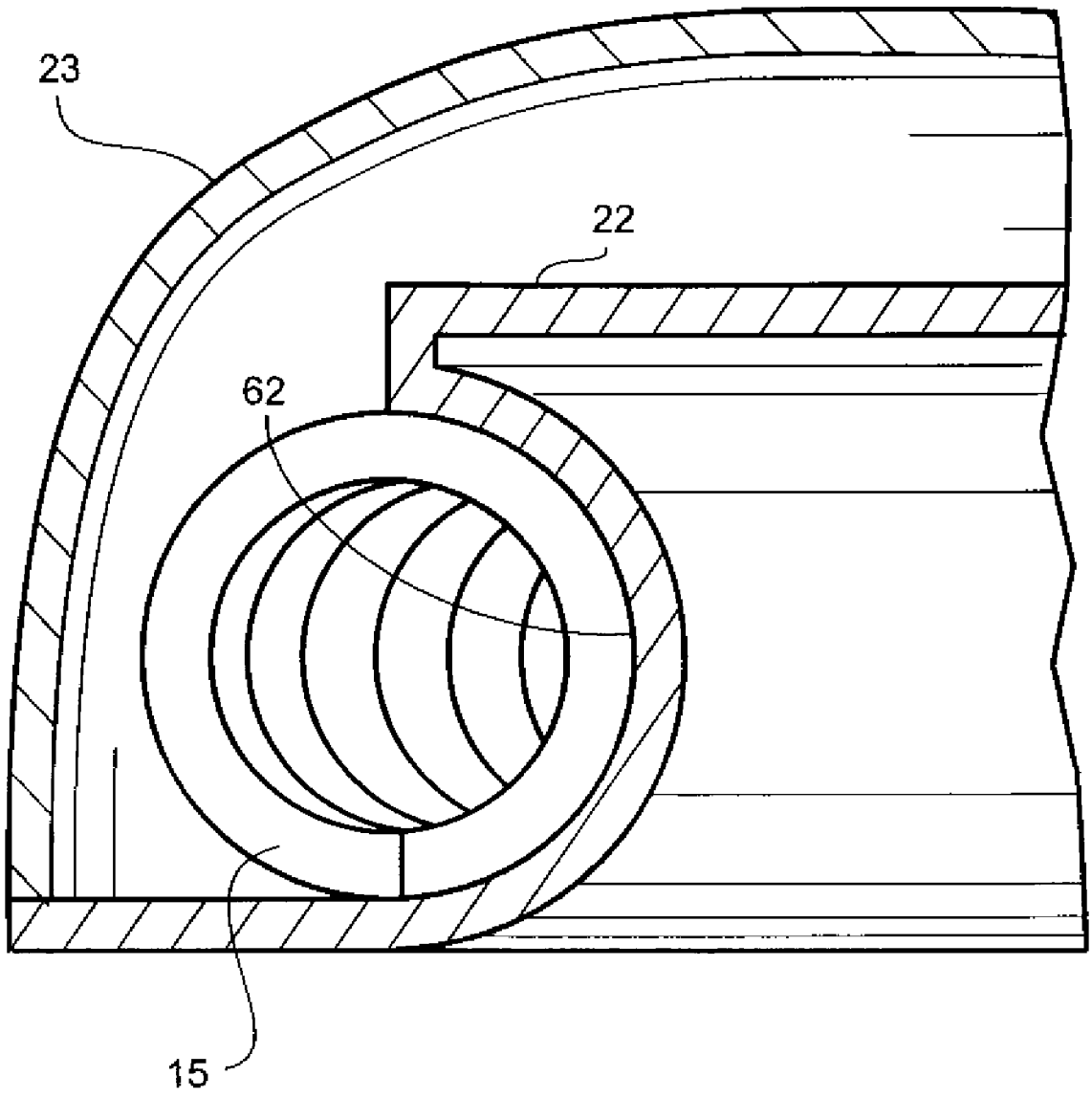
FIG. 5B is a detailed section view of the display stand of FIG. 5A taken along the line 5B-5B.

FIG. 5A and FIG. 5B show still another embodiment of the means 30 for dispensing and collecting the helical cable 15 according to the present invention. The helical cable 15 is shown collected (i.e. retracted) within the display stand 20 in FIG. 5A, the dispensed (i.e. extracted) configuration being substantially identical to the embodiments previously described. As shown, the base 22 of the display stand 20 is configured to be mounted onto the top of a display surface, such as a counter, table, shelf or desk. In addition, the aesthetic and protective cover 23 of the display stand 20 is shown exploded upwardly from the base 22 and in broken lines for purposes of clarity.

In this embodiment, the means 30 comprises a smooth, scalloped surface 62 disposed about the outer periphery of the base 22. As used herein, the term "scalloped surface" is intended to mean a generally concave, curvilinear or arcuate surface defined by the outer periphery of the base 22, as best shown in FIG. 5B. The surface 62 supports and guides the helical cable 15 on the base 22 to the passageway 25 of the collection tube 24. In particular, the helical cable 15 is guided along the scalloped surface 62 on the outer periphery of the base 22 between the base and the inner surface of the cover 23 of the display stand 20. Preferably, the surface 62 is formed from a metal or hard plastic so as to minimize the amount of friction between the surface 62 and the helical cable 15. As will be readily apparent to those skilled in the art, the surface 62 may be provided with a coating, for example a layer of Teflon® or the like, or lubrication to further reduce friction between the surface 62 and the helical cable 15. In an alternative embodiment, a relatively thin strip of the previously described low-friction material (not shown) may be affixed, for example by an adhesive, to the surface 62 about at least a portion of the outer periphery of the base 22.

In the particular embodiment shown in FIG. 5A, the surface 62 is formed on the outer periphery of the base 22 in a generally sideways U-shaped configuration. The helical cable 15 extends from a fixed connection 16, such as a connector plug or jack electrically coupled to the power supply, along the surface 62 around the outer periphery of the base 22. The helical cable 15 extends in a counter-clockwise direction (as viewed from above) along the surface 62 to the opening of the U-shape, towards the center of the base 22, and then upwardly into the collection tube 24. The helical cable 15 is dispensed when the article of merchandise 12 is lifted off the display stand 20 and is collected again when the article is replaced onto the display stand, as previously described. It should be noted that due to the coiled geometry of the helical cable 15, a greater length of the helical cable passes over the portion of the surface 62 nearer the entrance to the passageway 25 of the collection tube 24 than over the portion of the surface 62 nearer the fixed connection 16 since a greater amount of the elongation from the retracted length to the extracted length occurs adjacent the end of the helical cable 15 attached to the sensor 14. Accordingly, a progressively lesser length of the helical cable 15 passes over the portion of the surface 62 located medially between the passageway 25 of the collection tube 24 and the fixed connection 16. In any event, the helical cable 15 is intended to be guided along the outer periphery of the base 22 and is not guided, supported, retained or mechanically restrained in any way by the inner surface of the cover 23. As such, the cover 23 may be eliminated without compromising the function and/or operation of the display stand 20, and in particular the means 30 for dispensing and collecting the helical cable 15, except for the aesthetic and security benefits provided by the cover.

The foregoing has described exemplary embodiments of a security system for displaying articles of merchandise, while deterring theft and preventing inadvertent removal of the merchandise from a display area by an unauthorized person. In each exemplary embodiment, the security system includes a display stand and means for dispensing and collecting a helical cable attached to an article of merchandise. In the exemplary embodiments shown and described herein, the means for dispensing and collecting includes a plurality of wheels, a plurality of rollers, a smooth surface and/or a low-friction material, and a scalloped surface for guiding the helical cable between a refracted length and an extracted length.

While particular embodiments of the present invention have been described, it will be apparent to those skilled in the art that various modifications thereto can be made without departing from the spirit and scope of the invention. Accordingly, the foregoing description of preferred embodiments of the invention and the best mode for practicing the invention are provided for the purpose of illustration only, and not for the purpose of limitation. In particular, it will be appreciated that a display stand including means for dispensing and collecting a helical cable in accordance with the present invention may be applicable for use with various articles and with or without an accompanying security system.

That which is claimed is:

1. A display stand for displaying an article of merchandise comprising:

a base defining an outer periphery; and means disposed entirely on the outer periphery of the base for dispensing and collecting a helical cable attached to the article of merchandise;

wherein the means for dispensing and collecting supports and guides the helical cable along the outer periphery of the base between a retracted length of the helical cable and an extracted length of the helical cable.

2. The display stand according to claim 1, wherein the means for dispensing and collecting disposed on the outer periphery of the base defines an arcuate surface for supporting and guiding the helical cable along the arcuate surface as the helical cable is moved between the retracted length and the extended length.

3. The display stand according to claim 1, wherein the means for dispensing and collecting comprises at least one wheel disposed on the outer periphery of the base.

4. The display stand according to claim 3, wherein the at least one wheel is rotatably mounted to the base.

5. The display stand according to claim 3, comprising a plurality of wheels arranged in a generally U-shaped configuration.

6. The display stand according to claim 1, wherein the means for dispensing and collecting comprises at least one roller disposed on the outer periphery of the base.

7. The display stand according to claim 6, wherein the at least one roller is rotatably mounted to the base.

8. The display stand according to claim 6, comprising a plurality of rollers arranged in a generally U-shaped configuration.

9. The display stand according to claim 1, wherein the means for dispensing and collecting comprises a low-friction surface disposed on the outer periphery of the base.

10. The display stand according to claim 9, wherein the low-friction surface has a generally reverse J-shaped configuration.

11. The display stand according to claim 9, wherein the low-friction surface has a generally inverted J-shaped configuration.

12. The display stand according to claim 11, wherein the low-friction surface comprises an arcuate portion that depends outwardly from the outer periphery of the base and a linear portion that is parallel and in contact with the outer periphery of the base.

13. The display stand according to claim 9, wherein the low-friction surface is made of a low-friction material selected from the group consisting of silicone, polytetrafluoroethylene, perfluoroalkoxy, fluorinated ethylene propylene, Teflon®, and equivalents thereof.

14. The display stand according to claim 1, wherein the means for dispensing and collecting comprises a scalloped surface disposed on the outer periphery of the base.

15. The display stand according to claim 14, wherein the scalloped surface has a generally sideways U-shaped configuration.

16. The display stand according to claim 1 further comprising a collection tube mounted on and depending from the base, the collection tube having an interior passageway formed therethrough for delivering the helical cable to the article of merchandise.

17. A display stand for displaying an article of merchandise having a helical cable attached thereto, the display stand comprising:

a base defining an outer periphery; and a low-friction surface disposed entirely on the outer periphery of the base for dispensing and collecting the helical cable attached to the article of merchandise, the low-friction surface comprising an arcuate portion that depends outwardly from the outer periphery of the base and a linear portion that is parallel and in contact with the outer periphery of the base, the low friction surface supporting and guiding the helical cable along the outer periphery of the base as the helical cable is moved between a retracted length with the article of merchandise supported on the display stand and an extracted length with the article of merchandise removed from the display stand.

18. A display stand for displaying an article of merchandise having a helical cable attached thereto, the display stand comprising:

a base defining an outer periphery; and a generally U-shaped surface disposed entirely on the outer periphery of the base for dispensing and collecting the helical cable attached to the article of merchandise, the U-shaped surface supporting and guiding the helical cable along the outer periphery of the base as the helical cable is moved between a retracted length with the article of merchandise supported on the display stand and an extracted length with the article of merchandise removed from the display stand.

* * * * *